US006416212B1

(12) United States Patent
Rogers et al.

(10) Patent No.: US 6,416,212 B1
(45) Date of Patent: Jul. 9, 2002

(54) METHOD AND APPARATUS FOR MIXING MATERIALS IN A BAG WITH A MOVABLE PLUNGER

(76) Inventors: Christopher Roy Rogers, 1 Tricks Terrace, Beaford, Winkleigh, Devon (GB), EX19 8LP; Richard Tipton Smith, Myrtle Cottage, Beaford, Winkleigh, Devon (GB), EX19 8LT ( * ) Notice: Subject to any disclaimer, the term of this patent is extended or adjusted under 35 U.S.C. 154(b) by 0 days.

(21) Appl. No.: 09/674,937

(22) PCT Filed: Mar. 7, 2000

(86) PCT No.: PCT/GB00/00826

§ 371 (c)(1),
(2), (4) Date: Nov. 8, 2000

(87) PCT Pub. No.: WO00/53303

PCT Pub. Date: Sep. 14, 2000

(30) Foreign Application Priority Data

Mar. 9, 1999 (GB) ..... 9905312

(51) Int. Cl.[7] ..... B01F 11/00
(52) U.S. Cl. ..... 366/117; 366/200; 366/204
(58) Field of Search ..... 366/108, 110, 366/111, 113, 114, 117, 197, 198, 200, 201, 202, 203, 204, 208, 212, 332–335

(56) References Cited

U.S. PATENT DOCUMENTS 1,437,880 A * 12/1922 Baker
2,235,942 A * 3/1941 Moore
2,336,438 A 12/1943 Evans
2,356,004 A * 8/1944 Price
2,406,535 A * 8/1946 Foote
2,419,330 A * 4/1947 Anderson
2,462,286 A * 2/1949 Rhodes
3,096,081 A * 7/1963 Helm et al.
3,132,848 A * 5/1964 Garlinghouse
3,211,432 A * 10/1965 Van Rossem
3,595,530 A * 7/1971 Hubers
3,740,028 A * 6/1973 Bodine
3,819,158 A * 6/1974 Sharpe et al.
3,833,203 A * 9/1974 Garlinghouse
4,198,166 A * 4/1980 Tuns
5,600,964 A * 2/1997 Da Dalto et al.
6,045,253 A * 4/2000 Sullivan
6,142,661 A * 11/2000 Lafond
6,273,600 B1 * 8/2001 Sharpe

FOREIGN PATENT DOCUMENTS

EP 255780 * 2/1988
EP 671130 * 9/1995

* cited by examiner

*Primary Examiner*—Charles E. Cooley
(74) *Attorney, Agent, or Firm*—Ira S. Dorman

(57) ABSTRACT

Building materials such as concrete, mortar and plaster are placed in a bag which is suspended in a bottomless drum. A handle is used to move a plunger up-and-down through the bottom of the drum such that the plunger repeatedly moves part of the bag upwardly through the materials contained in the bag to cause mixing thereof. The drum is rotationally indexed with reciprocal movements of the plunger, which also moves laterally. The plunger has an interchangeable head having a leading face which is inclined with respect to the direction of lateral movement on the upward stroke, and at least one inclined downwardly-facing facet.

5 Claims, 7 Drawing Sheets

METHOD AND APPARATUS FOR MIXING MATERIALS IN A BAG WITH A MOVABLE PLUNGER

TECHNICAL FIELD OF THE INVENTION

This invention relates to the mixing of materials to produce a homogeneous mixture. Without prejudice to the generality, the invention is particularly applicable to the mixing of powder or granular materials, e.g. cement and sand, and to the mixing of such materials with a liquid, e.g. plaster with water.

BACKGROUND

EP 0 255 780-A discloses a method of preparing a homogeneous mixture of powder or granular materials, e.g. sand and cement, with a liquid, in which the materials to be mixed are placed in a bag which is then rolled to tumble the materials.

In EP 0 671 130-A food products are mixed with a condiment by placing the materials into a bag such that the mouth of the bag is suspended from a plurality of bars which move vertically to tumble the contents of the bag.

The present invention seeks to provide a new and inventive method of mixing materials and a new and inventive apparatus for performing the method.

SUMMARY OF THE INVENTION

The present invention proposes a method of preparing a homogeneous mixture of two or more materials which comprises:

- placing the materials to be mixed into a bag of flexible material;
- suspending the bag from an upper region thereof above a plunger; and
- producing relative up-and-down movement between the bag and plunger such that the plunger repeatedly moves part of the bag upwardly through the materials contained in the bag to cause mixing thereof.

The invention further provides mixing apparatus comprising:

- holding means for suspending a bag from an upper region of said bag;
- a plunger located below said holding means; and
- means for producing relative up-and-down movement between said holding means and said plunger such that when a bag containing materials to be mixed is suspended from said holding means the plunger repeatedly moves part of the bag upwardly through the materials contained in the bag to cause mixing thereof.

Whilst such relative movement could be produced by moving the bag vertically onto a static plunger, or by moving both the bag and the plunger, it is preferred to move the plunger while the bag remains stationary.

Preferably the amount of relative movement is sufficient to cause the bag to protrude above the mean surface level of the bulk of the material being mixed.

In order to provide an improved mixing action the plunger preferably moves in a non-linear path. It is further preferred to provide for relative rotational indexing between the plunger and the bag with reciprocation of the plunger.

The plunger preferably includes interchangeable heads. A particularly preferred form of head for use in mixing plaster has a leading face which is inclined with respect to the direction of lateral movement of the plunger on its upward stroke. The head preferably includes at least one downwardly inclined facet to increase mixing during downward movement of the plunger.

DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
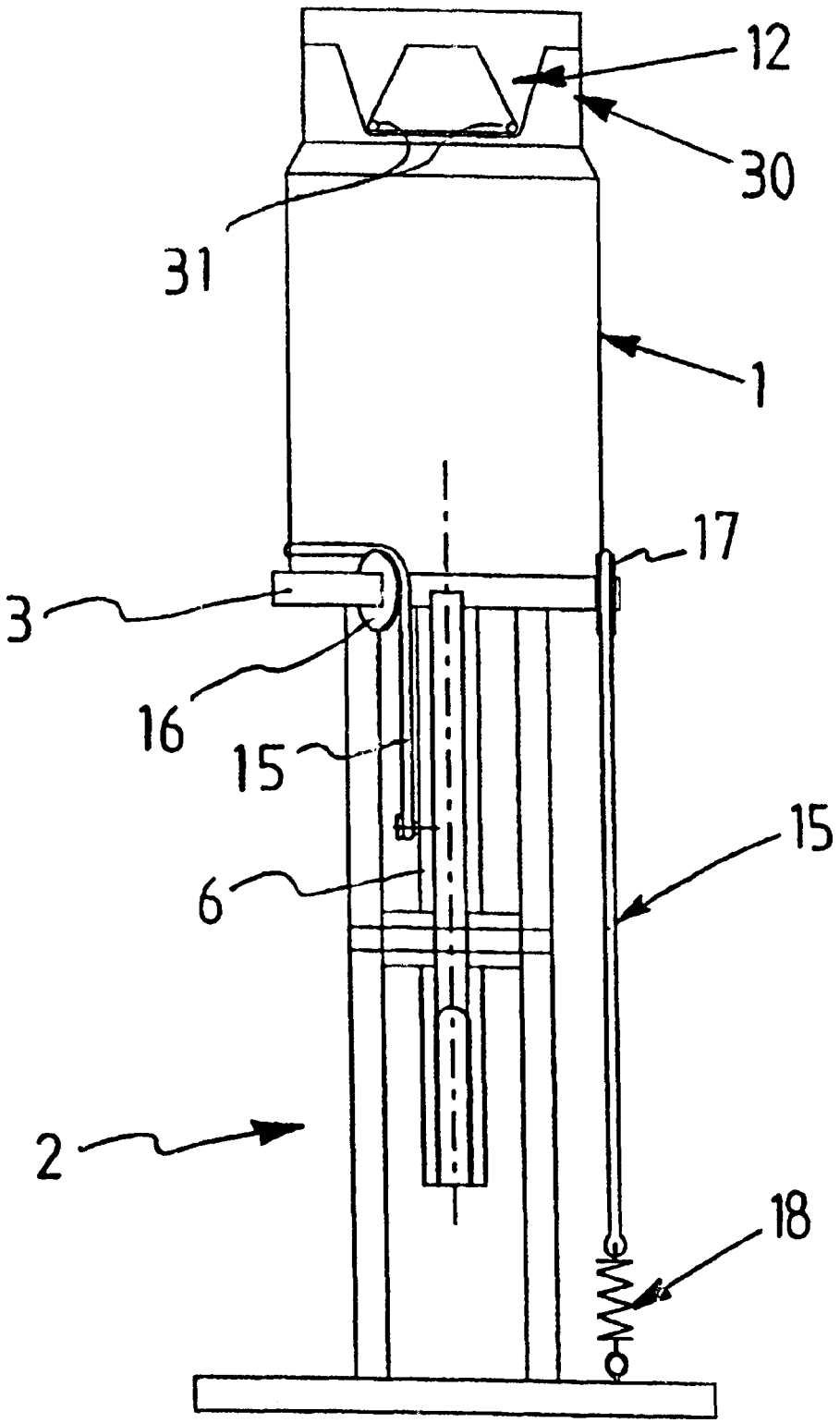
FIG. 1 is a front view of a hand-operated form of a mixing machine in accordance with the invention.
Figure 2:
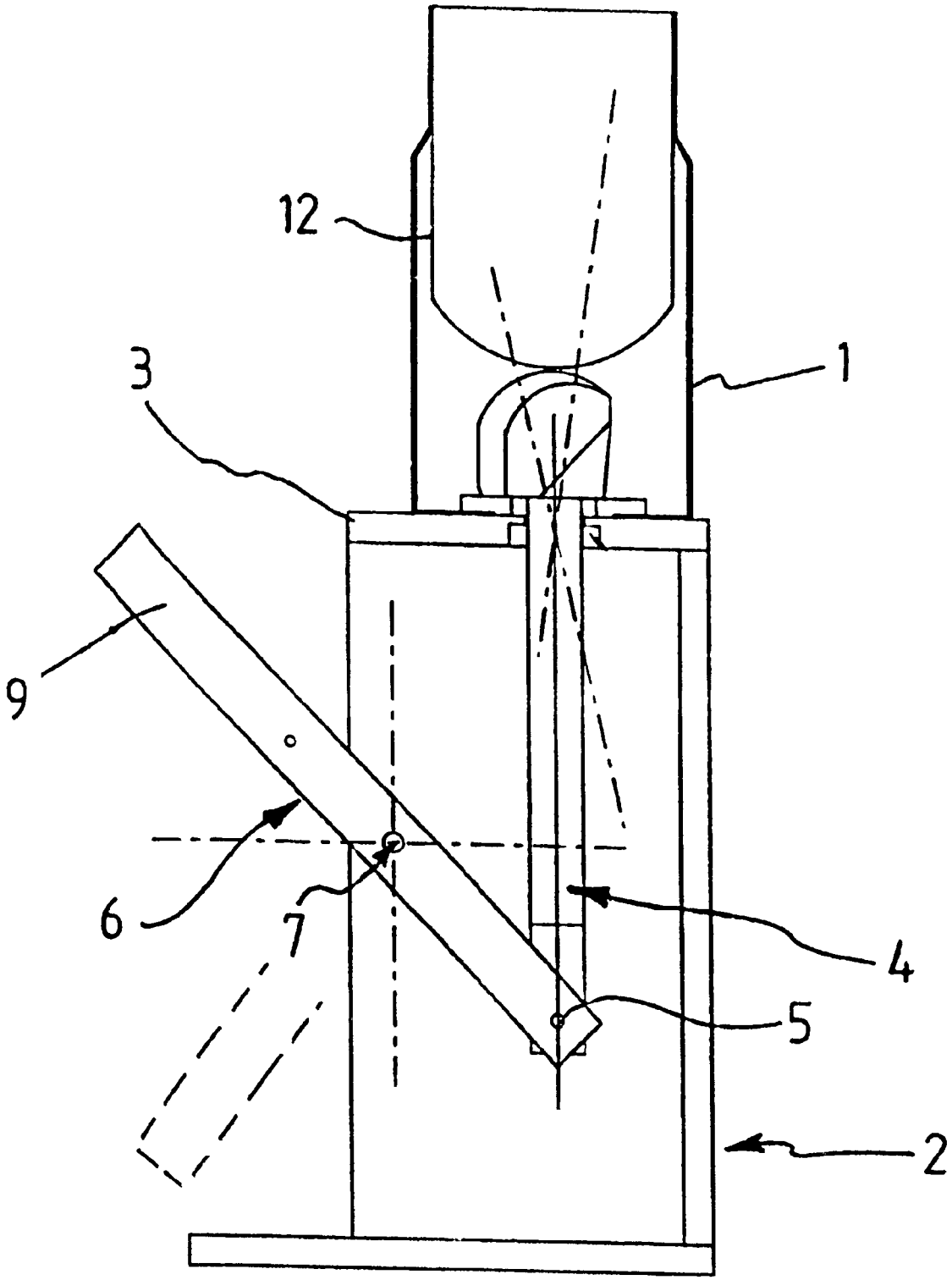
FIG. 2 is a vertical section through the machine taken in a front-rear direction.

Referring firstly to FIGS. 1 and 2, the machine comprises a cylindrical bottomless drum 1 which is rotatably mounted on a framework 2 including a drum-support platform 3. A plunger 4 projects upwardly through a guide hole or linear bearing in the approximate center of the platform 3, the lower end of the plunger being pivotally connected at 5 to one end of a handle 6. Part-way along its length the handle 6 is pivotally connected at 7 to the framework 2 to pivot in a substantially vertical plane, with a hand-grip 9 being provided on the free end of the handle which projects from the framework 2. Thus, by manually moving the handle up and down the plunger 4 is caused to reciprocate up and down through the platform 3.

A flexible bag 12 can be placed into the drum 1 and the mouth of the bag secured and held open by engagement with suitable holding means provided at the top of the drum (see below). It will be noted in FIG. 2 that the sides of the drum are stepped outwardly so that there is a gap between the sides of the bag and the drum to allow the sides of the bag to bulge outwardly as the plunger rises.

Simple means are also provided for rotational indexing of the drum 1 using friction. A cord 15 is attached to the handle 6 between the hand grip 9 and the pivot 7. The cord then passes over a guide pulley 16 (FIG. 1) loops once around the drum 1 and then, after passing over a second guide pulley 17, travels vertically downwards to be tensioned by a spring 18 secured to the framework 2. As the handle moves down, the cord tightens around the drum and rotates it, but when the handle moves up the cord is loosened and slips on the drum, being pulled back by the spring. Other means of indexing the drum could of course be used. A simple ratchet system could employ angled teeth moulded into the drum body and its supporting surface so as to engage in the reverse direction. Other ways of preventing reverse rotation are possible such as a sprag clutch. The rotation could also be produced in other ways such as a lever engaging one of a ring of teeth formed on the drum and then returning to engage the next tooth. The drum is preferably indexed by one sixth to one quarter of a complete revolution on each upward movement of the plunger.

Figure 3:
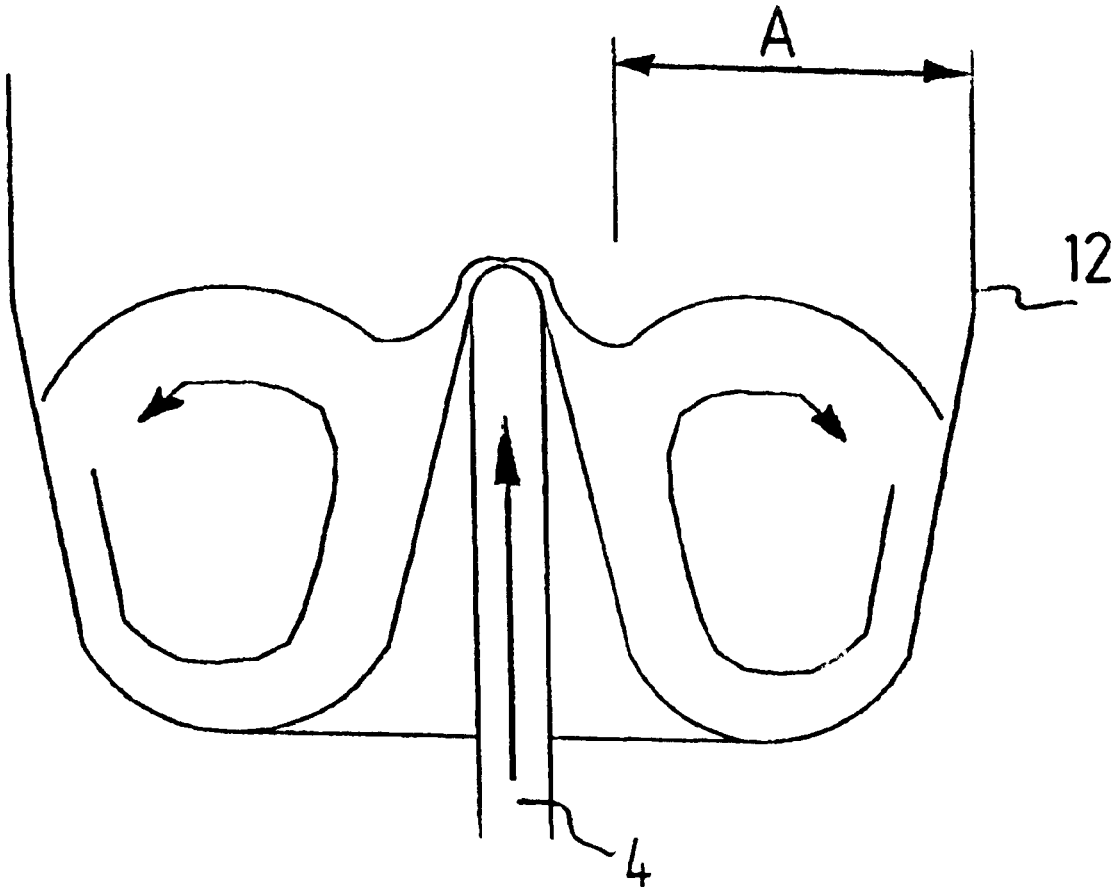
FIG. 3 is a diagrammatic vertical section through a bag placed in the mixing machine, in the course of a mixing operation.

The bag 12 is partially filled with the materials to be mixed and the hand grip 9 is moved downwards to raise the plunger 4 which lifts the bottom of the bag upwards through the materials until it is clear of their surface, either centrally as shown in FIG. 3, or eccentrically. The plunger is then lowered until it is clear of the bag again. The stroke of the plunger can be varied so that the plunger may remain in contact with the bag, and the bottom of the bag may not necessarily break the surface of the material. It can be observed that as the bottom of the bag is pushed through the materials of the mix it lifts material with it and material at the edge of the bag is dragged with the bag surface towards the plunger. This produces a rolling annular doughnut-shaped motion of the materials in the bag (assuming a substantially central plunger) as indicated by arrows in FIG. 3. When the plunger moves down again a similar but reverse rolling motion is produced.

When the materials being mixed are both liquids these actions are not particularly dimension sensitive but with powdered or granular solids, thixotropic mixtures or viscous liquids, the dimension A of the annulus of material surrounding the plunger has to be sufficient for the mixture to roll. If it is too small the rolling action is reduced. However, it has been observed that with, for instance, sand and water repeated actions producing even a very small rolling movement will eventually cause the water to wet the sand making it flow better and producing increasingly the desired rolling action.

The bags, when filled, may be approximately round when viewed from above but other shapes of bag may be used and may have advantages. As the wall of the bag rolls from the side towards the centre the wall of the bag wrinkles and folds reducing the circumferential distance over which the material is spread. This produces a further mixing action in addition to the basic roll. Again this action is reversed as the plunger direction reverses.

Figure 4:
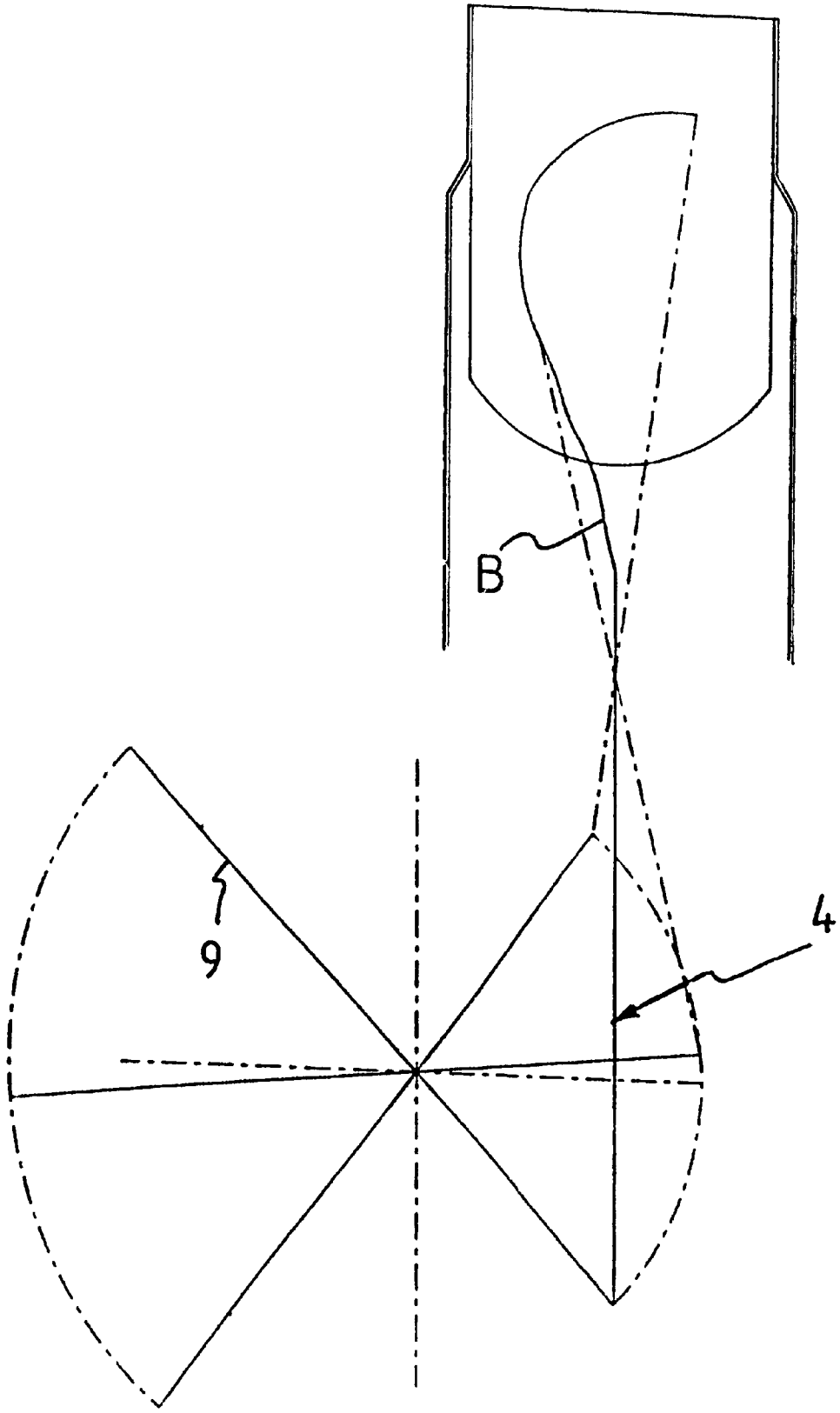
FIG. 4 is a diagrammatic representation of the path taken by the operating mechanism of the machine.

It has been observed that if the plunger moves linearly up-and-down centrally of the bag there is little sideways mixing. However, by making the plunger move in a plane as it rises so that it approaches the side of the bag and then moves towards the opposite side, there is an improved mixing action, particularly on the side where the plunger approaches the bag. By shaping the head of the plunger to closely approach the walls of the drum an additional squeezing action is produced which, while unsuitable for coarser materials such as sand/cement mixes, is very desirable with finer powders such as plaster which tend to form lumps or balls of partially mixed material. The squeezing action helps to break up such lumps or balls. The plunger may be spring-loaded to press against the edge of the hole in the platform 3 so as to limit the extent of this squeezing action. Curve B in FIG. 4 indicates the path taken by the head of the plunger 4 as it is moved up-and-down by the hand grip 9. The mixing is further enhanced by the rotational indexing of the bag and drum with each upward movement of the plunger.

Figure 5:
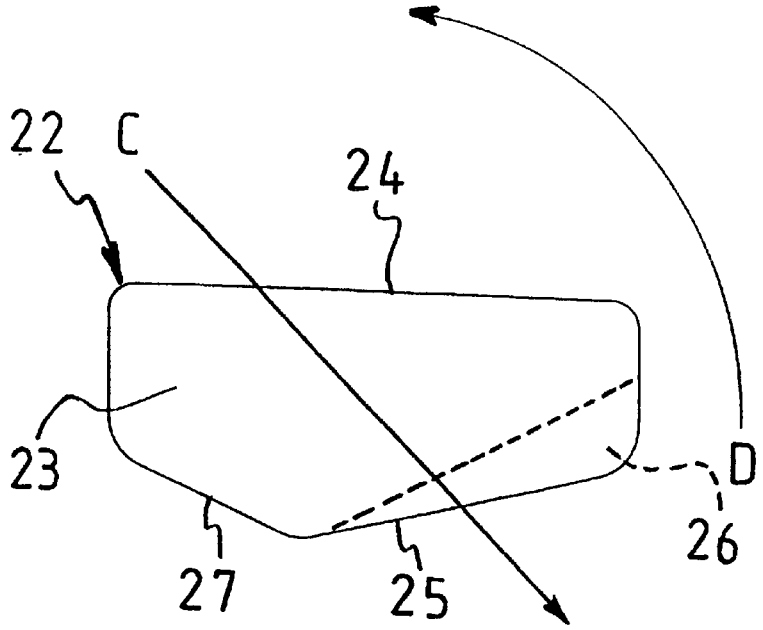
FIGS. 5, 6 and 7 are top, front and left hand end views respectively of a mixing head for use in the machine.
Figure 6:
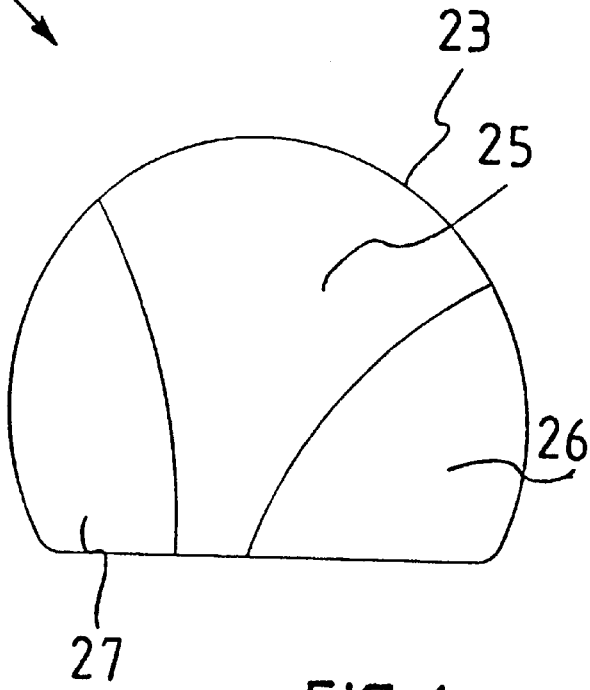
Figure 7:
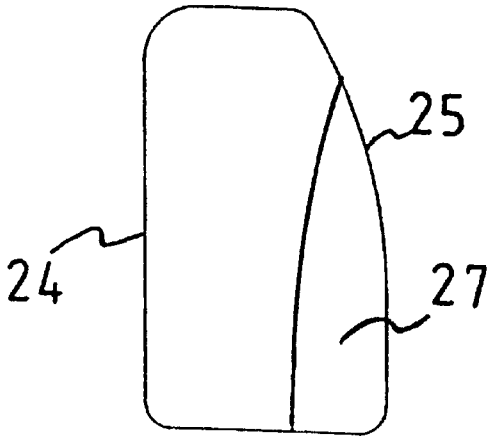

It has been found that a simple cylindrical plunger with a rounded end, as shown in FIG. 3, will work satisfactorily with coarse granular material such as a sand/cement and water mortar, but for mixing fine powders a larger diameter plunger is required. The plunger may thus have interchangeable differently shaped heads to suit different materials. FIGS. 5 to 7 show a preferred shape for the head of the plunger when mixing fine powder materials with a liquid, e.g. plaster and water. The head 22 has a part-cylindrical top surface 23 with a flat rear face 24 and a front face 25 which is upwardly curved towards the rear face 24 (see FIG. 7). One end of the front face 25 is faceted at 26 in the direction of the rear face 24 whilst the opposite end is undercut with a further downwardly facing facet 27. The head 22 is mounted on the plunger such that it moves in the direction of arrow C with the upward stroke of the plunger, whilst the drum 1 is indexed in direction D. The front face 25 is thus inclined with respect to the forward direction of movement C. The head closely approaches the side of the bag towards the end of the upward stroke and the rotation of the bag brings material into the wedge formed between the bag and the angled plunger face 25. This wedgeing is accentuated by the downwardly-directed facet 26 so that as the plunger travels downwards it acts on the mix to produce an additional mixing action.

Another possible development is to attach a link to the plunger close to the pivot 5 and pivot the link to the mixer body horizontally in line with the pivot 7 so as to produce a three dimensional movement of the plunger. The various pivot points would need to be universal joints to allow for three dimensional swivelling.

It will be appreciated that a desired lateral movement of the plunger could also be assisted if the plunger is not straight.

The internal face of the drum 1 may include guides such as spiral flutes to change the flow of the material, or projections which bring the bag closer to the end of the plungers path so as to shear the mix.

It is advantageous to use a bag with handle apertures formed therein and to hang the bag within a detachable collar 30 (FIG. 1) by folding the bag over the top of the collar and engaging the handles over holding means in the form of lugs 31 on the collar. The collar then locates into the top of the drum and may be secured with a bayonet fitting or clips for example. The collar may also have a folding carrying handle.

Figure 8:
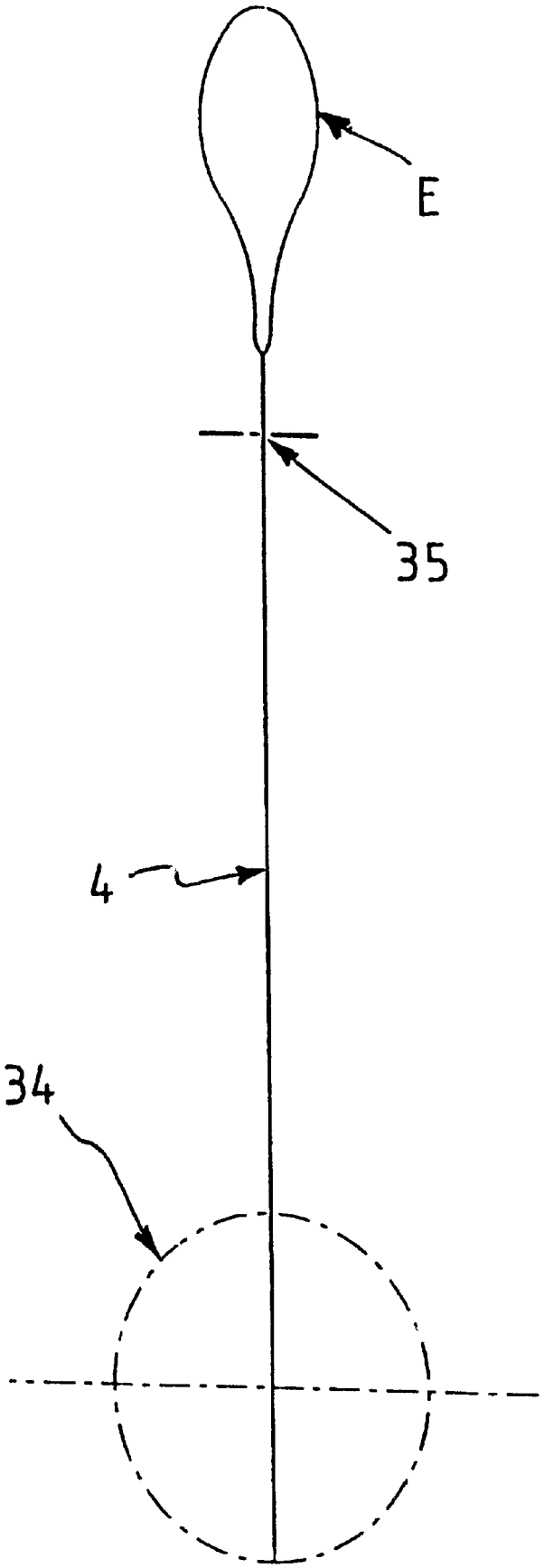
FIG. 8 is a diagram illustrating the motion produced by a crank mechanism which may be used in the machine.

It will be appreciated that instead of the handle 9 a low powered electric motor could be used to reciprocate the plunger by means of an eccentric, crank or cam. The motion E generated by the head of a plunger operated by a crank type mechanism moving in a circle 34 is shown in FIG. 8. The plunger 4 is guided through a fixed linear bearing at 35.

The method of mixing within a flexible bag may be used for many applications as in the mixing of building materials such as concrete, mortar and plaster. The use of a bag offers the oportunity to produce complete mixing systems where the bag forms the packaging for the materials themselves and the means of delivering the mixed materials to where they are to be used. Such a system offers valuable advantages. At one end of the scale there is a need to mix small quantities of building materials for repair work which at present have to be mixed by hand with a trowel or similar tool and then carried in a bucket to the job. This is tedious, involves either mixing on a floor or on a surface which then has to be cleaned, transferring into a bucket which will subsequently need cleaning with water with the consequent problem of where to dispose of the resulting slurry. By utilising the invention the materials can be purchased packed in the bag, mixed in the bag using a simple hand powered or electrically driven machine located close to where the material is needed, dispensed from the bag with any surplus remaining in the bag, and the used bag finally being disposed of with no cleaning required other than the tools used to apply the mix. This offers considerable advantages in convenience particularly to the DIY market.

The simple hand mixer can also be used to effectively mix plaster and water, which is known to be one of the most difficult materials to successfully homogenise. The best technique is as follows. Partially move the plunger a few times to level the measured quantity of plaster. Pour a measured quantity of water into the bag covering the plaster evenly. Wait for the bubbles of air escaping to stop. Move the plunger about half its normal movement for ten or so strokes which spreads the water within the plaster. Follow this with about a hundred full strokes and this should produce a good homogeneous mix. This process can be successfully scaled up to handle about half a sackful of plaster at a time.

The mixer could also be used with empty bags supplied for the purpose, allowing the effective mixing of any suitable materials that the user may have available.

Figure 9:
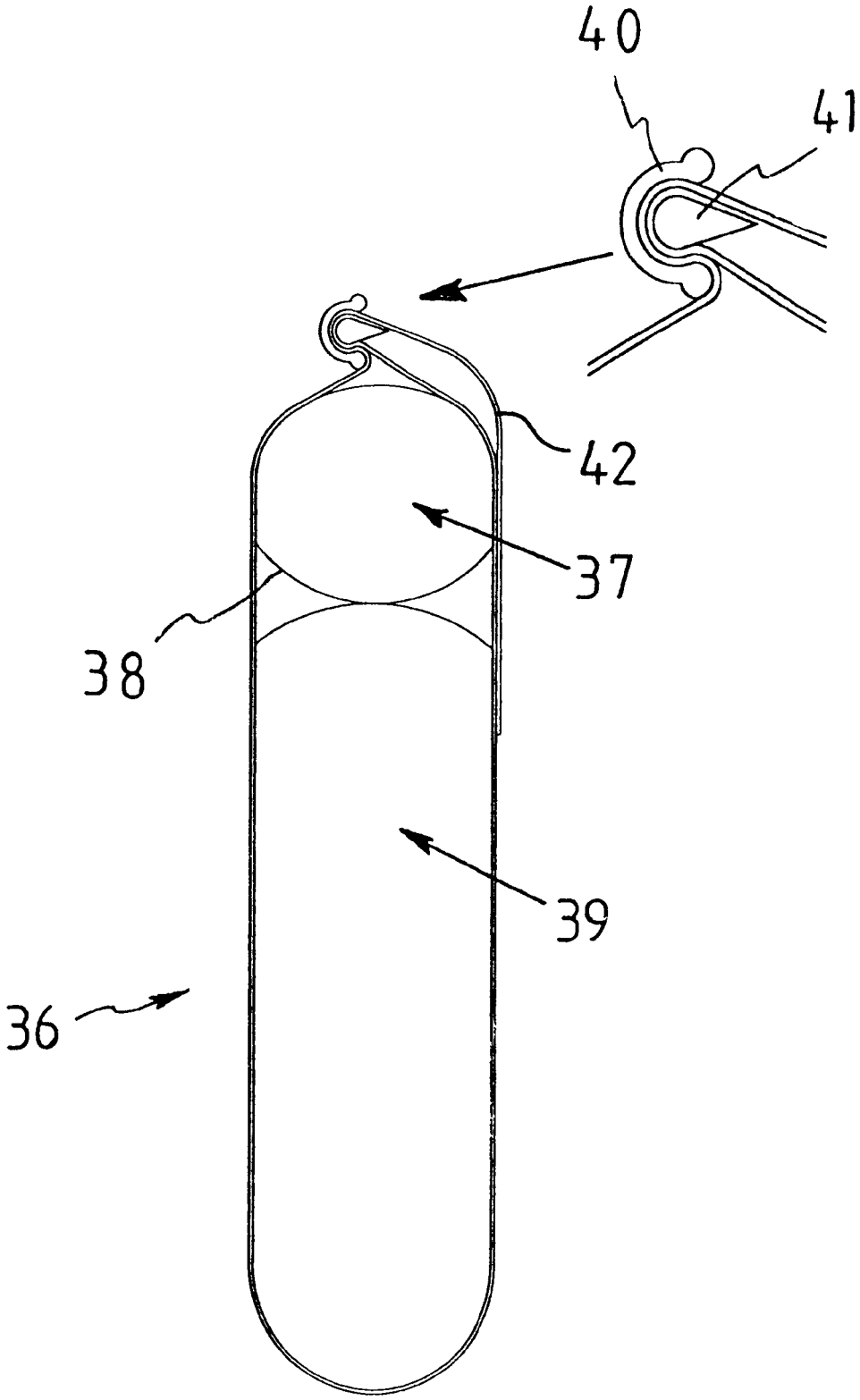
FIG. 9 is a bag in which materials to be mixed can be supplied for use in the machine.

A larger version of the mixer can be used for mixing mortar and plaster in quantities similar to those used on building sites. Plaster cannot be mixed in a concrete mixer so is presently mixed in a bucket which is a particularly messy operation. Mixing mortar or concrete in a conventional concrete mixer involves using a shovel to transfer sand and aggregate, which is usually delivered loose or in bulk bags, into the mixer, which already contains water. This is back breaking work. A much smaller quantity of cement is then added to complete the mix which is then poured into a wheelbarrow and moved to where it is required. With the present invention the sand or sand/aggregate mix can be delivered directly in flexible bags in manually handleable quantities, an example of which is shown in FIG. 9. These bags 36 may incorporate handles integrally formed from the bag material or have separate handles secured thereto. The bags may also incorporate a plastic molding to hold the bag open and support it directly in the drum, equivalent to the detachable collar described above. The cement 37 may be packed separately in a sealed plastic bag 38 placed on top of the sand or aggregate mix 39 and the bag closed. The bag may be closed for instance with two interlocking plastic strips 40 and 41 (see inset detail) which trap the mouth of the bag between them immediately above the filling point. If the bag has integrally formed handles the extra length 42 of the bag can then be folded back over the filled section for convenient palletising and transport. The bag is typically delivered to site on a pallet. The user can carry the bag to the mixer using the handles and place it in the drum. The drum can either be retracted or an internal support could be raised so that the bag is supported so that the handles can be placed around lugs on an integral or separate collar previously placed in position at the top of the drum. The bag seal is broken by removing the two sealing strips 40 and 41 and the handles positioned over the holding lugs. The sealed cement bag (if used) is opened and its contents added to the contents of the bag 36. An automated form of the machine is preferred wherein the user simply closes a lid on top of the bag and presses a start button. The drum then rises or the internal support drops, leaving the bag hanging just clear of the plunger. The plunger then moves through a number of reciprocating cycles to carry out an initial dry mixing if required and then water and plasticiser are automatically metered into the bag and mixing carried on for a preset number of strokes to complete the mixing. The drum then sinks, or the internal support rises, so that the bag is again supported. The handles can then be unhooked and the bag of mix lifted out and taken to the job. When the mix has been used the bag can be discarded or collected for recycling.

A similar automated machine can be used to mix plaster operating with an appropriately modified cycle. The bag just contains plaster, and only water has to be added.

The advantages of the present invention compared with how building materials such as plaster are mixed at present may be summarised as follows:

1. No dust or mess problems during mixing.
2. Exactly the right measured quantity of water is added each time to produce consistent mixes. Variations in batches of plaster could have a correction for the water quantity carried on the bag.
3. No dirty bucket and mixer to clean.
4. The plasterer could do his own mixing saving on labour costs.
5. The plasterer handles more acceptable weights.
6. Residues of used plaster and similar materials can be left to harden in the bag. The bag is then manipulated using the machine or manually to break up the hardened material which can then be removed from the bag and disposed of cleanly.

At the top end of the scale it is possible to envisage concrete aggregate being mixed in large bags holding perhaps a quarter to half ton with only the cement being added by hand and the bag being moved by forklift. Such bags may include a valve or tied bottom to facilitate discharge of the contents.

In larger machines hydraulic operation of the plunger becomes more attractive. An hydraulic or electric linear actuator drive system could consist of one actuator mounted in a spherical bearing and carrying the plunger end mounted directly underneath the bag. The other end of this actuator could be attached with universal joints to two other actuators mounted at an angle to each other and in a roughly horizontal plane so that they can be used to position the lower end of the plunger actuator within its possible spherical surface. By controlling the individual extension and movement speeds of the actuators extremely complex movements of the plunger head could be generated. With such machines more than one plunger may of course be used.

Due to the large surface area of the materials which is exposed during mixing, the process could be carried out under a vacuum in order to produce very effective de-aeration of a mixture.

It will be appreciated that the features disclosed herein may be present in any feasible combination. Whilst the above description lays emphasis on those areas which, in combination, are believed to be new, protection is claimed for any inventive combination of the features disclosed herein.

What is claimed is:

1. A method of preparing a homogeneous mixture of two or more materials which comprises:

placing the materials to be mixed into a bag (12) formed of flexible material;

suspending three bag from an upper region thereof above a plunger (4); and producing relative up-and-down movement between the bag and plunger such that the plunger repeatedly moves part of the bag upwardly through the materials contained in the bag to cause mixing thereof;

characterised by relative lateral movement (B) between the plunger and the bag during such relative up-and-down movement, and by relative rotational indexing between the plunger and the bag with reciprocation of the plunger.

2. A method according to claim 1, in which the amount of said relative up-and-down movement is sufficient to cause the bag to protrude above the mean surface level of the bulk of the material being mixed.

3. Mixing apparatus comprising:

holding means (31) for suspending a bag (12) from an upper region of said bag;

a plunger (4) located below said holding means, said plunger having a head (22) with a leading face (25);

means (6) for producing relative up-and-down movement between said holding means and said plunger such that: said plunger moves up-and-down whilst said holding means remains stationary; relative lateral movement (B) occurs between the plunger and the bag during such relative up-and-down movement; said plunger moves laterally on its upward stroke with said leading face (25) inclined with respect to the direction (C) of said lateral movement; and, when a bag containing materials to be mixed is suspended from said holding means, the plunger repeatedly moves part of the bag upwardly through the materials contained in the bag to cause mixing thereof; and means (15) for producing relative rotational indexing between the plunger and the bag with reciprocation of the plunger.

4. Mixing apparatus according to claim 3, in which said plunger head (22) has at least one inclined downwardly-directed facet (26).

5. Mixing apparatus according to claim 3, in which the plunger is provided with interchangeable heads.

* * * * *